GASEOUS FLUID COMPRESSING APPARATUS

Conventional air compressors and the like usually have a recommended maximum speed and operation above that maximum reduces the compressor efficiency. The compressing apparatus of U.S. Pat. No. 3,403,845, issued Oct. 1, 1968 was adapted to operate at various speeds with subtantially the same efficiency wherein the out-put was proportional to the relative speeds. However, the volumetric efficiency was limited by the amount of gaseous fluid that was drawn into the cylinder by the intake valve in the piston.

The principal object of the present invention are: to provide a gaseous fluid compressor apparatus including a reciprocating compressor with an intake valve in each piston that may be operated at various speeds including low and relatively high speed and provide an out-put proportional to the respective speed; to provide such a compressor apparatus with cylinders mounted on and communicating with the interior of crankcase compartments for flow of fluid to be compressed from a respective crankcase compartment to the cylinder through the piston therein with said flow being controlled by reciprocation of the piston and opening and closing of the intake valve therein; to provide such a compressor apparatus with crankcase compartments shaped to cooperate with the crankshaft throws and counterbalances and provide crankcase compression and rotary impellers to charge the cylinders with intake air at superatmospheric pressure; to provide such a compressor and super-charging that has a output greater per minute than the actual volume of the cylinders multiplied by the number of strokes per minute; to provide such a compresor apparatus with a discharge valve reciprocably mounted in the cylinder head and of a size substantially that of the cross-section of the cylinder bore and opening in response to pressure in the cylinder for cooperation with the piston and intake valve for providing substantially maximum fluid moving value of the piston stroke and to provide a compressor apparatus that is economical to manufacture, easily maintained and that provides substantially positive displacement whereby the output varies with the speed of operation.

Other objects and advantages of this invention will become apparent from the following description taken in connection with the accompanying drawings wherein are set forth, by way of illustration and example, certain embodiments of this invention.

Figure 3:
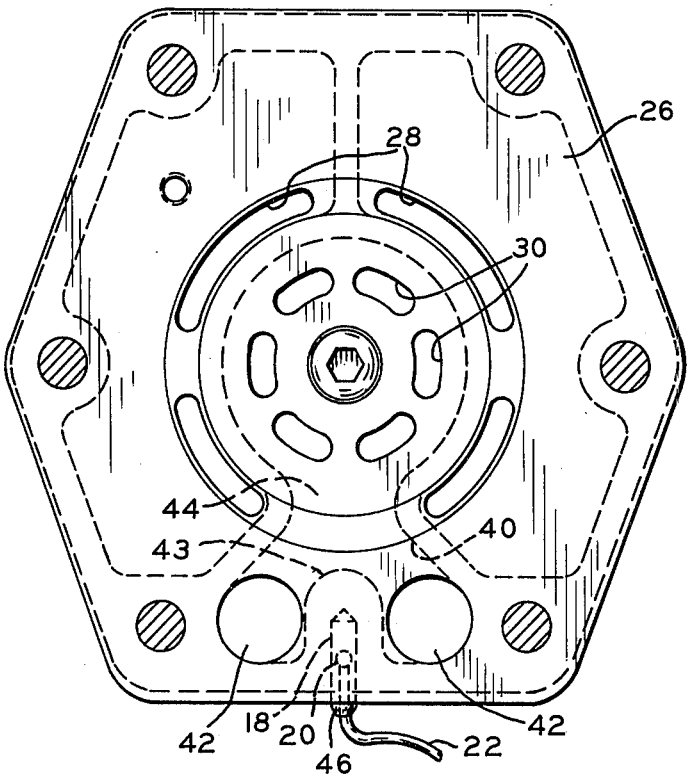
FIG. 3 is a vertical sectional view through the compressor apparatus taken on the line 3—3, FIG. 2.
Figure 4:
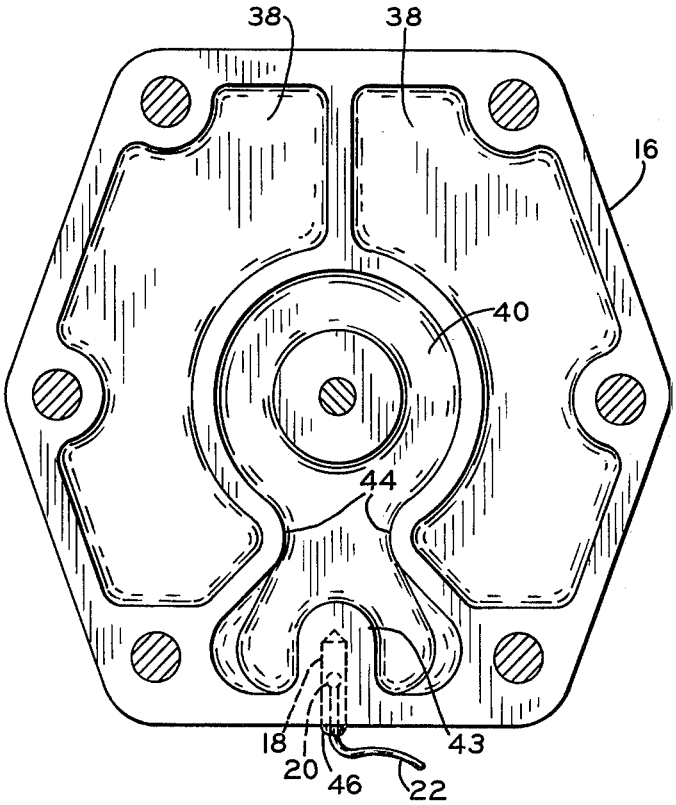
FIG. 4 is a transverse sectional view through the compressor taken on the line 4—4, FIG. 2.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a respresentative basis for teaching one skilled in the art to variously employ the present invention in virtually any appropriately detailed structure.

The reference numeral 1 generally designates a compressing system for gaseous fluid such as air and the like which includes a compressor 2, a receiver 3 and a flow passage 4 providing flow communication between the compressor discharge 5 and the receiver or tank 3. In the structure illustrated, the compressor is driven by a motor 6 through a variable speed reducer 7 with the drive and compressor supported on a base plate 8 mounted on the receiver 3.

The compressor includes a crankcase or housing 9 having suitable bearing structures 10 rotatably supporting a crankshaft 11. The compressor may have one or more cylinders, the structure illustrated is a two cylinder compressor with a cylinder block 12 secured to the crankcase 9 and having cylinder bores 13. The crankcase shown has a partition 14 dividing it into compartments 15, there being a separated compartment for each cylinder. The crankshaft extends through the partition with one of the bearing structures 10 therein and the crankshaft has a throw 16 in each compartment with the crankpin of the respective throws rotatably mounted in a bearing 17 at one end of a respective connecting rod 18. In the structure illustrated, the compressor is of the vertical type, however, it is to be understood it could also be horizontal or other conventional positioning without change of function or operation. Also the connecting rod 18 may be connected to the piston 19 through any conventional connection with a piston pin and bearing that permits the swinging movement of the connecting rod as the throw of the crankshaft is rotated in the crankcase.

The cylinder block 12 has bores 13 in which respective pistons 19 reciprocate. In the structure illustrated, the cylinder block has a bottom flange 20 secured to the crankcase 9 by means of suitable fastening devices such as bolts 21, the cylinder block being positioned with the bores 13 in axial alignment with respective crankshaft throws 16. The other end or discharge end of the cylinder block is provided with an outwardly extending flange 22 on which is mounted a cylinder head 23, the head being secured in place by bolts 24 having heads 25 engaging the cylinder head with bolt shanks 26 extending through the head and threaded into threaded openings 27 in the flange 22 whereby the cylinder head is held in sealing engagement with the cylinder block. The cylinder head has a portion 28 extending outwardly from the cylinder block and has a discharge opening 29 therein. A tubular member such as a pipe 30 has one end connected with the cylinder head portion 28 at the discharge opening 29 and the other end connected to the receiver 3 to define the flow passage 4. The cylinder head is hollow and communicates with the flow passage 4 for flow of fluid to the receiver as later described.

The discharge end of the cylinder block is bevelled outwardly from each bore 13 to provide valve seats 31 on which valve heads 32 seat in closing the discharge ends of the respective cylinder bores. Each valve head 32 has an elongate stem 33 reciprocably mounted in a bore 34 of a respective tubular guide member 35. In the structure illustrated, the guide members 35 are integral with the cylinder head with the bores 34 axially aligned with the respective cylinder bores 13. In the structure illustrated, the bores 34 have bushings 36 preferably of suitable oilless bearing material for reciprocably mounting the stems of the valve heads 32. The tubular guide members 35 have ends 37 adjacent to the valve heads 32 and are spaced therefrom to provide stops serving as limits to opening movement of the valve heads 32. It is preferred that light coil springs 38 be sleeved on the valve stems 33 to provide a light closing force to the valve heads to urge the discharge valves to closing position when the compressor is idle or is being started. After the compressor is in operation, there is pressure on the discharge side of the valves which urges the discharge valve heads 32 into seating engagement with the valve seats 31. The bushings 36 are preferably self-lubricating as for example of oilless bearing material or other suitable self-lubricating bearing material.

The pistons 19 each have a head 39 with a skirt 40 extending therefrom toward the crankcase. The periphery of the piston is provided with a plurality of spaced grooves in which are mounted suitable rings to engage the inner surface of the cylinder well. In the structure illustrated, a groove 41 adjacent the head 39 mounts a compression ring 42. A spring 43 is arranged between the ring 42 and the bottom of the groove 41 to aid in expanding the ring against the cylinder wall. The piston has a groove 44 intermediate the length thereof and a groove 45 adjacent the skirt end and mounted in the grooves 44 and 45 are wear rings 46 and 47 respectively, of suitably long wearing material such as graphite or other suitable oilless or self-lubricating material. It is preferred the wear ring 47 be a full ring and sleeved onto the skirt end of the piston and with such structure the ring 47 is retained on the piston by a keeper ring 48 mounted in a groove 49 adjacent the skirt end of the piston. A plurality of circumferentially spaced webs 50 are suitably secured to the skirt and extend inwardly therefrom with the inner ends secured to a tubular guide member 51 which has an axial bore 52 with a bearing sleeve 53 mounted therein, said sleeve preferably being of oilless bearing material or other suitable self-lubricating bearing material. An intake valve 54 has a stem 55 reciprocable in the sleeve 53 with the head 56 of said valve provided with a peripheral portion 57 seating on a valve seat 58 at the discharge end of the intake bore 59 in the piston head. The bore 59 and valve head 56 are as large as practical so as to offer substantially unrestricted movment of gaseous fluid from one side of the piston to the other.

While the valve seat 58 for the intake valve and the valve seat 31 for the discharge valve may be metal as by bevelling portions of the piston and cylinder, it is preferred that the seats be of a softer and resilient material. Therefore, the end portion of the cylinder is recessed as at 60 and the piston 19 is recessed as at 61 and secured in the recess 60 is a seat ring 62 having the seat 31 thereon and secured in the piston recess 61 is a seat ring 63 having the valve seat 58 thereon. It is preferred that the seat rings be formed of a silicon rubber that will withstand temperatures of up to 600° F. and has a durometer of the range of 80 to 100. Such seat rings provide a slight cushioning effect that reduces the impact of the closing of the valves and thereby provides a long wearing structure. The seat portions of the discharge valve heads 32 and of the intake valve heads 56 may be metal and preferably are coated as at 64 and 65 respectively with a silicon rubber or the like to facilitate the seal between the valves and seats.

The intake valve is opened and closed by pressure differential between the crankcase and cylinder and it is preferred that a light closing force be applied to said intake valves to urge said valves to closed position when the compressor is idle or is being started. In the structure illustrated, there is a light coil spring 66 sleeved on each of the intake valve stems 55 with ends engaging the guide member 51 and an abutment at the free end of the respective stem. The structure shown has a washer 67 and keeper 68 secured to the stem 55 to serve as the abutment. The springs 66, washer 67 and keeper 68 serve to limit the extent of opening movement of the intake valves.

In the structure illustrated, the end 69 of the connecting rod remote from the crankshaft is pivotally connected to the piston by a piston pin 70 suitably mounted on extensions or ears 71 on and extending from the skirt portion of the piston toward the crankcase. The piston pin 70 extends transversely of said piston whereby in response to rotation of the crankshaft, the connection of the connecting rods with the pistons effects reciprocation of the pistons in respective cylinder bores. In the structure illustrated, each of the connecting rods has a bore 72 at the piston rod end 69 with a bearing member 73 therein for rotatably receiving the piston pin 70 to form the pivotal connection between the connecting rod and piston.

The compressor has a structure that provides a delivery of air by the intake valve into the respective cylinders at superatmospheric pressure. The reciprocation of the pistons and opening of the cylinders to the crankcase compartments provides some crankcase compression, and the cooperative shape of the compartments and crankshaft throws and counterbalances provide rotating impellers that aid in drawing air into the respective compartments and moving same to the respective cylinder.

In the structure illustrated, the crankcase 9 has spaced end walls 74 and 75 with the partition 14 therebetween. The end walls and partition are connected to a bottom wall 76 and side walls 77 and 78 forming a closed structure with the cylinder block 12 secured to the upper end of the side, and end walls and the partition 14. The bearing members 10 are mounted in one end wall 74 and the partition and receive the bearing portions 79 and 80 of the crankshaft 11. The two cylinder compressor could have a three bearing crankshaft with another bearing member in the end wall 75, if desired, for better balance; however, a flywheel 81 may be fixed on the crankshaft portion 82 between the crankcase and a drive connection therewith from a power means such as the speed reducer 7, the crankshaft portion 82 extending from the bearing portion 79. To prevent escape of air through the bearing members, suitable seals are provided and in the illustrated structure each of the bearing members are sealed bearings to retain any lubricant and seal the bearing openings in the end wall 74 and partition 14.

The crankshaft is preferably sectional to permit installation in the sealed bearings and have similar bearings on the crankpins 83 and 84. In the structure illustrated, the crankshaft has arms 85 extending from the bearing portions 79 and 80 and mounting the crankpins 83 and 84. The arms 85 have bores 86 for receiving ends of the crankshaft bearing portions 79 and 80 and bores 87 to receive ends of respective crankpins 83 and 84 with suitable fastening means such as locking screws 88 in the arms securing each member in place to form a rigid structure. The arms 85 each have counterbalance portions 89 extending from the bearing portions 79 and 80 in opposed relation to the crankpins also the arms and counterbalance portions have faces adjacent the end wall 74 and partition to permit operation in closely spaced relation thereto.

The walls of the crankcase are shaped on the inside to define the compartments 15 with a contour that permits rotation of the crankshaft throws and counterbalance portions with a minimum of clearance both at the end walls 74, 75, partition 14, side walls and bottom wall, the interior of the side walls and bottom walls having a circular portion 90 substantially co-axial with the crankshaft bearing portions 79 and 80 and upper portions 91 inclined to provide for the angular positions of the connecting rods.

Intake ports 92 for each compartment are arranged in a lower portion of a side wall of the crankcase and communicate with the respective compartment through a passage 93 that has the lower surface generally tangential of the circular contour at the bottom of the compartment. The ports 92 are arranged in a side wall in relation to the direction of rotation of the crankshaft 11 whereby the passage 93 extends from the port in the same direction as the crankpin moves in the lower portion of the rotation of the crankshaft.

With the relationship between crankshaft rotation and the location of the intake ports, the counterbalance portions 89 move past the passage 93 as the piston is completing its compression stroke and tending to reduce pressure in the respective compartment and draw air therein whereby said counterbalance portion acts as an impeller aiding in drawing air through the port and moving same in a rotating path in the crankcase compartment. As the piston moves toward the end of its intake stroke the crank throws and crankpin move by the passage 93 and also acts as an impeller to draw in air and continue the whirling movement of air in the crankcase compartment. The whirling movement of the air past the tangential passage creates a condition causing air to move into the crankcase and provide a volume to charge the respective cylinder with intake air at superatmospheric pressure.

To facilitate starting the compressor or prevent overloading conditions on the power means driving the compressor an unloader is provided. In the structure illustrated, valves 94 are pivotally mounted on the crankcase adjacent the inlet ports 92. Suitable springs 95 on the mounting urge the valves 94 away from the ports 92 for full opening thereof. A lever 96 is connected by linkage 97 to the valves 94 and operable to selectively move the valves 94 to port closing position. With the ports 92 closed the pistons can reciprocate but no air is entering and the operation is substantially a no load condition. After the compressor is started and up to a desired speed the lever 96 is released whereby the springs 95 open the ports 92 for normal operation of the compressor.

The compressor structure permits a substantially oilless operation and thereby a clean air output that is oil free. In such a compressor the bearing bushings or members 36 and 53 mounting the discharge valve stem 33 and intake valve stem 55 respectively are oilless bearing material. The piston rings are of graphite or other oilless material. The bearings 73 and 17 in the connecting rod ends and pivotally mounted on the piston pin 70 and crank throw pins 83 and 84 respectively and the bearings 10 which rotatably support the crankshaft in the crankcase are sealed needle bearings providing long life without loss of lubricant or the like that might contemminate the air output.

Figures 1, 2, 3:
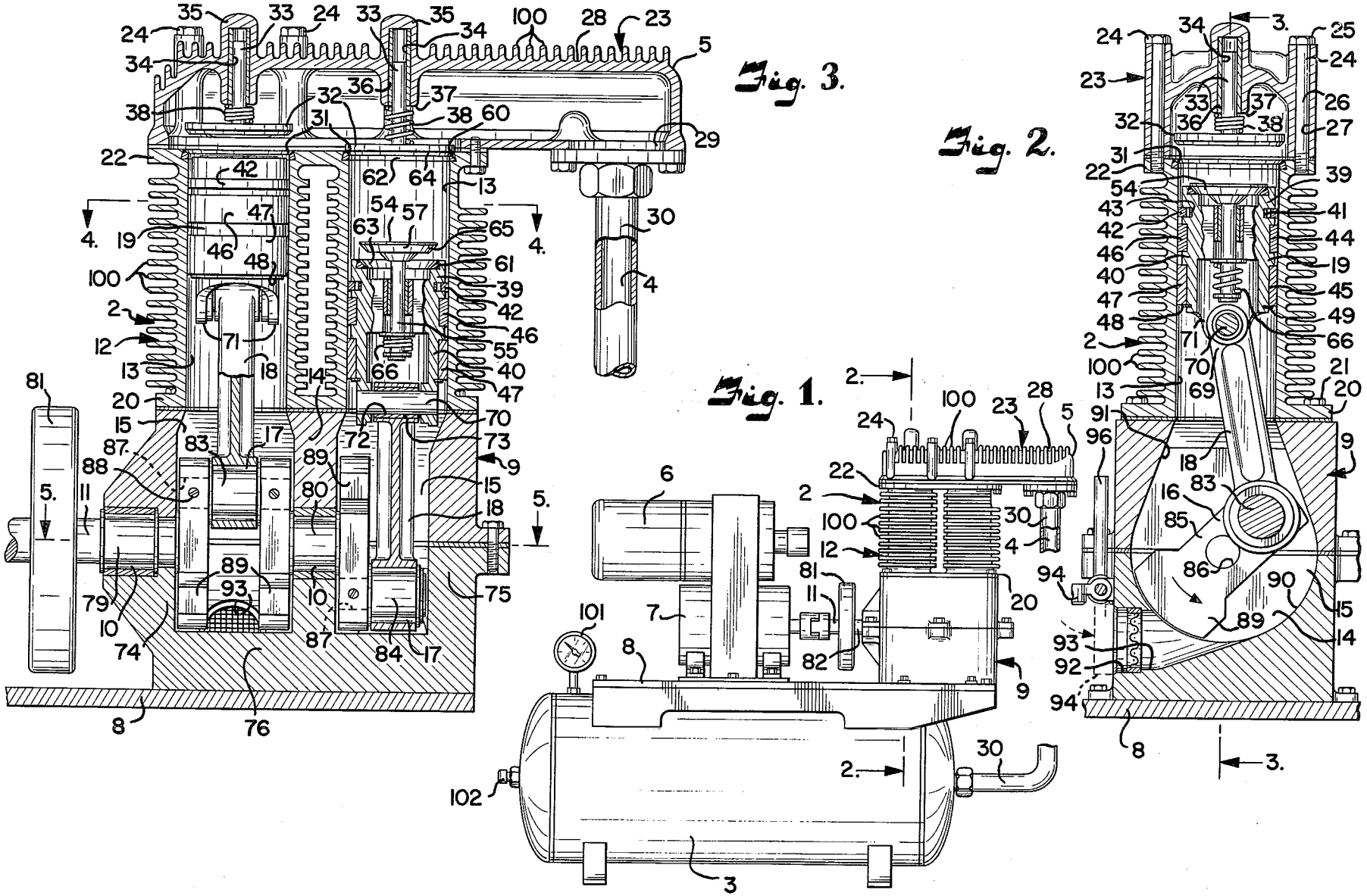
FIG. 1 is a side elevation of a compressor apparatus connected in a compression system including a flow passage and tank.
FIG. 2 is a vertical sectional view through the compressor structure taken on the line 2—2, FIG. 1.
Figure 6:
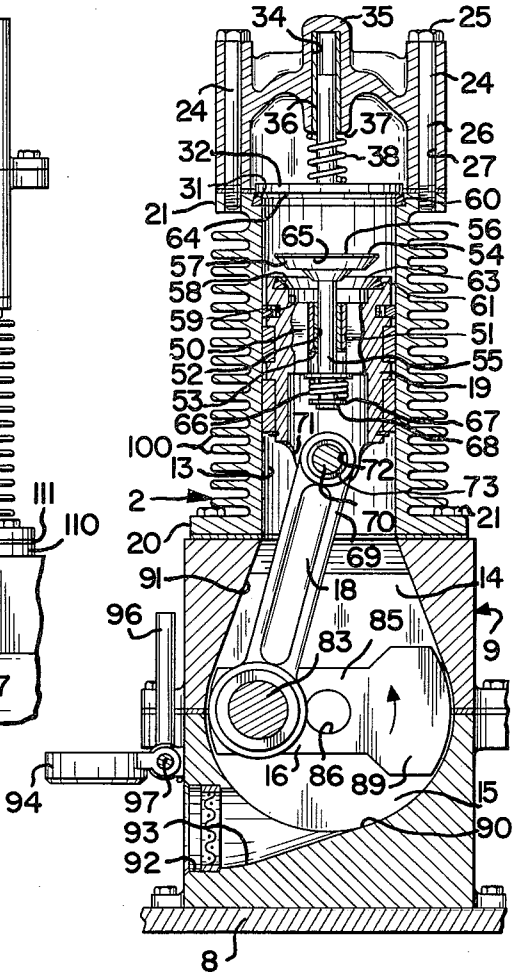
FIG. 6 is a view similar to FIG. 2 showing the position of the crankshaft throws and counterbalances midway of the suction stroke.

It is preferred as illustrated in FIG. 1 that the cylinder block 12 and cylinder head 23 have a plurality of closely spaced cooling fins 100 thereon to facilitate dissipation of heat from the compressor. The receiver or tank 3 may be of any conventional structure and preferably has a gauge 101 connected thereto and a suitably controlled outlet 102 leading to a point of utilization of the compressed fluid.

In operating a compressing system constructed and assembled as described, the speed reducer 7 is adjusted to provide the desired speed of the compressor. The motor 6 is then energized to drive the reducer and thereby turn the crankshaft 11 in the bearing structures 10 of the crankcase 9. As the crankshaft 11 is rotated the connecting rods connected to the respective crankshaft throws 16 reciprocate the pistons 19 in the respective cylinder bores 13. In the illustrated structure, the crank throws are 180° apart so that one piston is moving in the opposite direction to the other. As a piston is moved toward the discharge valve or cylinder head, it facilitates intake of fluid through the intake ports 92 into the respective crankcase compartment 15. The rotation of the crankshaft and movement of the throws and counterbalances thereof in the crankcase past the tangential passages tends to draw air into compartments and provide a whirling quantity of air that is delivered through the piston to the respective cylinder on the intake stroke. The intake valve opens during the intake stroke by the pressure differential between the cylinder and crankcase. The intake valve being open on the intake stroke causes fluid to be moved from the crankcase chamber into the cylinder bore between the piston head and the discharge valve. This continues until the piston reaches the end of its intake stroke, and the pressure differential acting on the intake valve approaches zero then the spring 66 moves the intake valve to a closed position. Then on the up stroke or compression stroke of the piston 19, the fluid is compressed between the piston and the discharge valve and when the pressure in the cylinder is such that a differential pressure acting on the discharge valve causes same to open, the fluid moves around the discharge valve head 32 through the cylinder head 23 and discharge opening 29 thereof and through the pipe 30 to the receiver or tank 3. When the piston has completed its compression stroke the differential pressure or pressure on each side of the discharge valve tends to equalize and the discharge valve moves to closed position on the respective seat 31 before the piston 19 starts down on its next suction or intake portion of its stroke.

Figure 7:
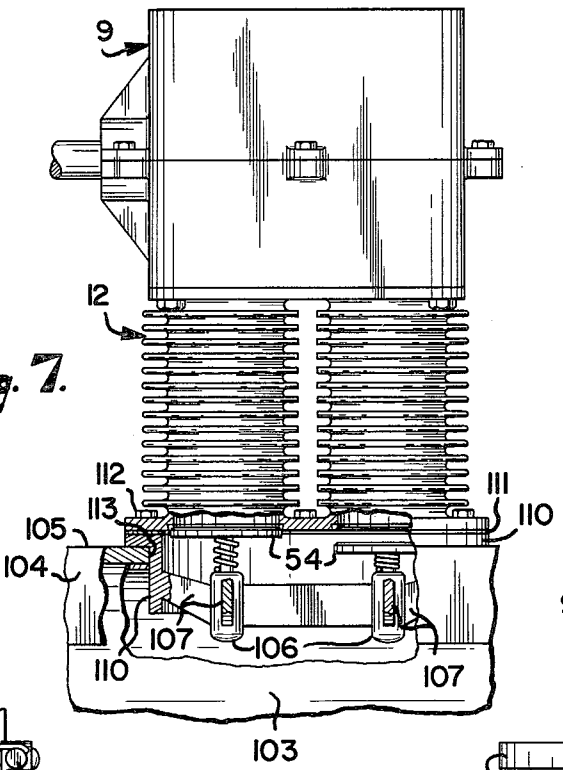
FIG. 7 is a vertical sectional view of a modified form of compressor and tank.
Figure 4:
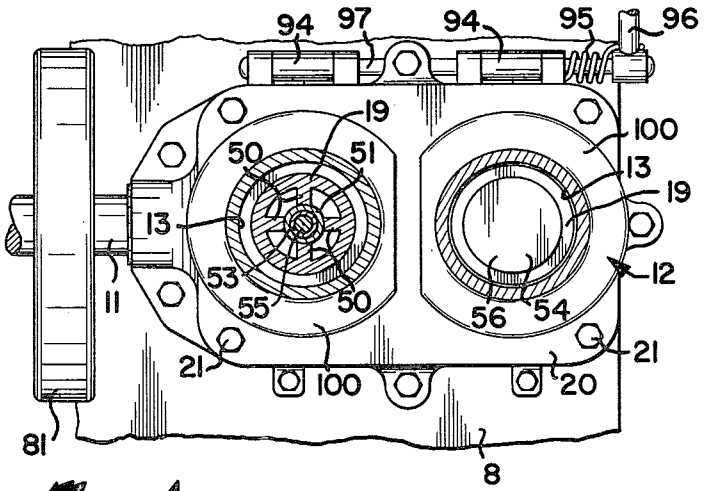
Figure 5:
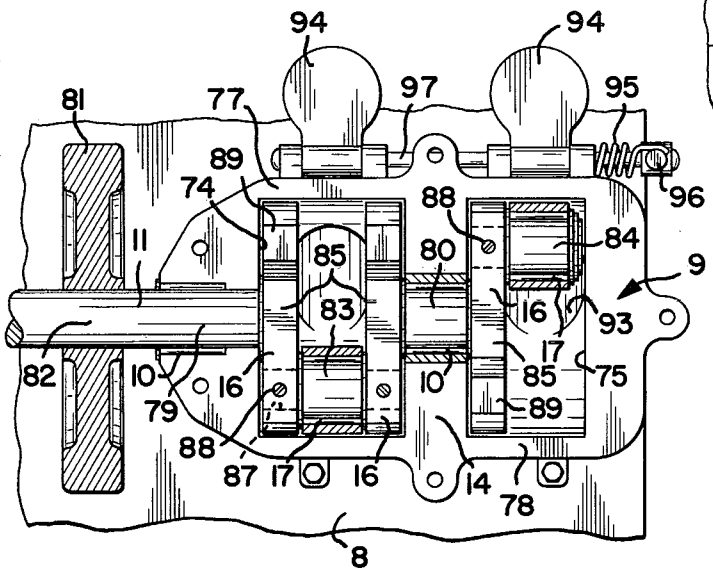
FIG. 5 is a transverse sectional view through the crankcase taken on the line 5—5, FIG. 2.

In the form of the invention illustrated in FIG. 7, the cylinder block 12, crankcase 9, pistons 19, intake valves 54 and all of the operating structure are substantially the same in structure and operation as shown in FIGS. 1 to 6 inclusive except that the structure is inverted and mounted on a receiver or tank 103 for discharge of air from the cylinders into the tank.

The tank 103 has a mounting member or portion 104 on the top side thereof and having a face 105. The guides 106 for the discharge valves may be supported on spaced arms 107 from the cylinder block, however, in the illustrated structure the arms 107 are on a mounting member or flange 110 positioned between the face 105 and a cylinder block flange with suitable gaskets 111 interposed with the flanges and mounting member 104 secured by fastening devices such as screws 112 to form a gas tight structure. The guides 106 are substantially the same as the guides members 35 and the discharge valves are mounted and operate the same as discharge valvds 32 seating on the seats on the cylinder block as described relative to the structure shown in FIGS. 1 to 6 inclusive. The mounting member 104 has an opening 113 of a size to encompass the cylinders whereby the discharge valves and guides 106 extend therein, said opening 113 providing communication with the interior of the tank 103.

The compressor structure shown in FIG. 7 operates in the same manner as that shown in FIGS. 1 to 6 inclusive except as the discharge valves open air is moved from the cylinders through the opening 113 into the tank 103. The discharge valves act as check valves to retain the air in the tank and prevent movement back through the cylinders.

It is to be understood that while certain forms of the invention have been illustrated and described, it is not to be limited to the specific form or arrangement of parts herein described and shown.

What I claim and desire to secure by Letters Patent is:

1. A gaseous fluid compressing apparatus having a cylinder with a bore therein, a compressed fluid discharge at one end of the cylinder, a discharge valve at said one end of the cylinder opening in response to fluid pressure in the cylinder bore, a piston reciprocable in the cylinder bore and an intake valve in the piston operating in response to pressure differential on opposed sides thereof, the improvement comprising:

a. a crankcase having walls defining an interior compartment and said cylinder extending therefrom with said cylinder bore communicating with said compartment;

b. a crank rotatably mounted in the crankcase and having a crank throw and opposed counterbalances in said compartment;

c. a connecting rod operably connecting said piston with said crank throw for reciprocating said piston in response to rotation of said crank;

d. said crankcase compartment being defined by surfaces adjacent to the paths of extremities of the crank throw and connecting rod as the crank is rotated;

e. an inlet port in the crankcase for gaseous fluid to be compressed, said inlet port having a passage extending therefrom to said compartment for movement of gaseous fluid from said inlet port to said compartment, said passage communication with said compartment being substantially tangentially and opposite from the location of entry to the cylinder bore and extending in the same direction as the movement of the crank throw when passing adjacent said passage whereby said crank throw, counterbalances and adjacent portion of the connecting rod function as impellers facilitating intake and compression of gaseous fluid to be compressed.

2. A gaseous compressor apparatus as set forth in claim 1 wherein:

a. said compressor apparatus is multiple cylinder with a respective piston in each cylinder bore connected by a connecting rod to a respective crankshaft throw;

b. said crankcase having means dividing the interior into separate compartments, there being a compartment for each cylinder and crankshaft throw;

c. each crankcase compartment having a separate independent inlet port for entry of fluid to be compressed.

3. A gaseous fluid compressing apparatus as set forth in claim 1 and including:

a. a valve member at said crankcase compartment inlet port and normally in open position for entry of gaseous fluid to said compartment;

b. means connected to said valve member and selectively operative to move the valve member to close the inlet port.

4. A gaseous fluid compressor apparatus as set forth in claim 1 including:

a. a hollow tank having a wall with an opening therein;

b. mounting means at said one end of the cylinder and fixing same to said tank wall around said tank wall opening with a fluid tight seal therebetween;

c. said discharge valve and mounting means providing direct discharge of compressed gaseous fluid from said cylinder bore to said tank.

5. A gaseous fluid compressor apparatus as set forth in claim 4 including:

a. said compressor apparatus being inverted with the cylinder extending upwardly from the tank and the crankcase being thereabove, the discharge of compressed gaseous fluid being directly into the tank.

6. A gaseous fluid compressing apparatus comprising:

a. a crankcase having walls defining an interior compartment and a cylinder block extending therefrom and having a through cylinder bore communicating at one end with the crankcase compartment;

b. a crank rotatably mounted in the crankcase and having a crank throw and opposed counterbalances in said compartment;

c. a piston reciprocable in said cylinder bore;

d. a connecting rod operably connecting the piston with said crank throw for reciprocating said piston in response to rotation of said crank;

e. a hollow cylinder head fixed on said cylinder block at the end remote from the crankcase and having a delivery means communicating with the interior of said cylinder head;

f. a discharge valve reciprocably mounted in the cylinder head and of a size substantially that of the cross-section of the cylinder bore and opening in response to pressure in the cylinder;

g. an intake valve in said piston opening for flow of fluid from the crankcase compartment to the cylinder between the piston and cylinder head in response to pressure differential between said crankcase compartment and said cylinder;

h. said crankcase compartment having a generally cylindrical surface portion terminating in surfaces extending toward the cylinder bore, said surfaces being in close proximity to the paths of outer extremities of the crank throw, counterbalance and connecting rod as the crank is rotated;

i. an inlet port in the crankcase for gaseous fluid to be compressed, said intake port having a passage communicating substantially tangentially with a portion of said compartment which is substantially opposite from the location of entry to the cylinder bore, said passage extending from said port to said compartment in the same direction as the movement of the crank throw when passing adjacent to said passage whereby said crank throw, counterbalances and adjacent portion of the connecting rod function as impellers for facilitating intake and compression of fluid to be compressed.

7. A gaseous compressor apparatus as set forth in claim 6 wherein:

a. said compressor apparatus is multiple cylinder with a respective piston in each cylinder bore connected by a connecting rod to a respective crankshaft throw;

b. said crankcase having means dividing the interior into separate compartments, there being a compartment for each cylinder and crankshaft throw;

c. each crankcase compartment having a separate indepedent inlet port for entry of fluid to be compressed.

8. A gaseous fluid compressing apparatus as set forth in claim 7 wherein:

a. said pistons have graphite wear rings for engaging the cylinders;

b. the connecting rod connections with the pistons have oilless bearings;

c. the mountings of the discharge valve and intake valves have oilless bearings;

d. the rotatable mountings of the crank in the crankcase have sealed bearings;

e. the connections of the connecting rods to the crank throws have sealed bearings whereby the apparatus is characterized by oil free compressed gaseous fluid output.

* * * * *